US005553719A

United States Patent [19]

Campbell

[11] Patent Number: 5,553,719

[45] Date of Patent: Sep. 10, 1996

[54] FLEXIBLE HAT STORAGE DEVICE

[76] Inventor: Rosita Campbell, 10071 E. Mary Dr., Tucson, Ariz. 85730

[21] Appl. No.: 357,851

[22] Filed: Dec. 16, 1994

[51] Int. Cl.[6] ..... A47F 7/00

[52] U.S. Cl. ..... 211/30; 211/88; 211/113; D6/525; 383/117

[58] Field of Search ..... 211/88, 30, 118, 211/113; 248/303, 304, 205.3, 176.1; D32/36; D6/525, 553; 383/117, 119

[56] References Cited

U.S. PATENT DOCUMENTS

D. 316,646 5/1991 Cunningham ..... D6/525 X
4,015,719 4/1977 Hanopole ..... 211/133
4,228,834 10/1980 Desnick ..... 383/117 X
4,664,266 5/1987 Fausett et al. ..... 211/88 X
4,756,498 7/1988 Frye ..... 248/205.3

*Primary Examiner*—Robert W. Gibson, Jr.

[57] ABSTRACT

A device for supporting a plurality of hats relative to a vertical support structure. The inventive device includes a mounting assembly for securing to a wall or door. A flexible receiving assembly depends from the mounting assembly to receive a plurality of hats to be stored.

6 Claims, 4 Drawing Sheets

FLEXIBLE HAT STORAGE DEVICE

BACKGROUND OF THE INVENTION

1. Field of the Invention

The present invention relates to receiving support structures and more particularly pertains to a flexible hat storage device for supporting a plurality of hats relative to a vertical support structure.

2. Description of the Prior Art

The use of receiving support structures is known in the prior art. More specifically, receiving support structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art receiving support structures include U.S. Pat. Nos. 5,295,588; 5,240,123; 5,137,152; 5,092,472; and U.S. Design Pat. No. 269,486.

While these devices fulfill their respective, particular objectives and requirements, the aforementioned patents do not disclose a flexible hat storage device for supporting a plurality of hats relative to a vertical support structure which includes a mounting assembly for securing to a wall or a door, and a flexible receiving assembly depending from the mounting assembly for receiving a plurality of hats to be stored.

In these respects, the flexible hat storage device according to the present invention substantially departs from the conventional concepts and designs of the prior art, and in so doing provides an apparatus primarily developed for the purpose of supporting a plurality of hats relative to a vertical support structure.

SUMMARY OF THE INVENTION

In view of the foregoing disadvantages inherent in the known types of receiving support structures now present in the prior art, the present invention provides a new flexible hat storage device construction wherein the same can be utilized for supporting a plurality of hats relative to a vertical support structure. As such, the general purpose of the present invention, which will be described subsequently in greater detail, is to provide a new flexible hat storage device apparatus and method which has many of the advantages of the receiving support structures mentioned heretofore and many novel features that result in a flexible hat storage device which is not anticipated, rendered obvious, suggested, or even implied by any of the prior art receiving support structures, either alone or in any combination thereof.

To attain this, the present invention generally comprises a device for supporting a plurality of hats relative to a vertical support structure. The inventive device includes a mounting assembly for securing to a wall or door. A flexible receiving assembly depends from the mounting assembly to receive a plurality of hats to be stored.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new flexible hat storage device apparatus and method which has many of the advantages of the receiving support structures mentioned heretofore and many novel features that result in a flexible hat storage device which is not anticipated, rendered obvious, suggested, or even implied by any of the prior art receiving support structures, either alone or in any combination thereof.

It is another object of the present invention to provide a new flexible hat storage device which may be easily and efficiently manufactured and marketed.

It is a further object of the present invention to provide a new flexible hat storage device which is of a durable and reliable construction.

An even further object of the present invention is to provide a new flexible hat storage device which is susceptible of a low cost of manufacture with regard to both materials and labor, and which accordingly is then susceptible of low prices of sale to the consuming public, thereby making such flexible hat storage devices economically available to the buying public.

Still yet another object of the present invention is to provide a new flexible hat storage device which provides in the apparatuses and methods of the prior art some of the advantages thereof, while simultaneously overcoming some of the disadvantages normally associated therewith.

Still another object of the present invention is to provide a new flexible hat storage device for supporting a plurality of hats relative to a vertical support structure.

Yet another object of the present invention is to provide a new flexible hat storage device which includes a mounting assembly for securing to a wall or a door, and a flexible receiving assembly depending from the mounting assembly for receiving a plurality of hats to be stored.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
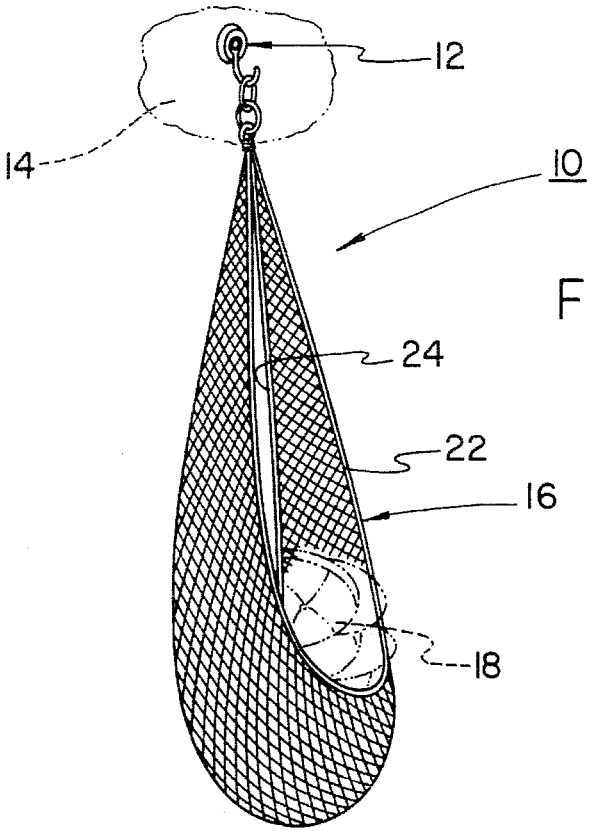
FIG. 1 is an isometric illustration of a flexible hat storage device according to the present invention in use.

With reference now to the drawings, and in particular to FIGS. 1–8 thereof, a new flexible hat storage device embodying the principles and concepts of the present invention and generally designated by the reference numeral 10 will be described.

Figure 2:
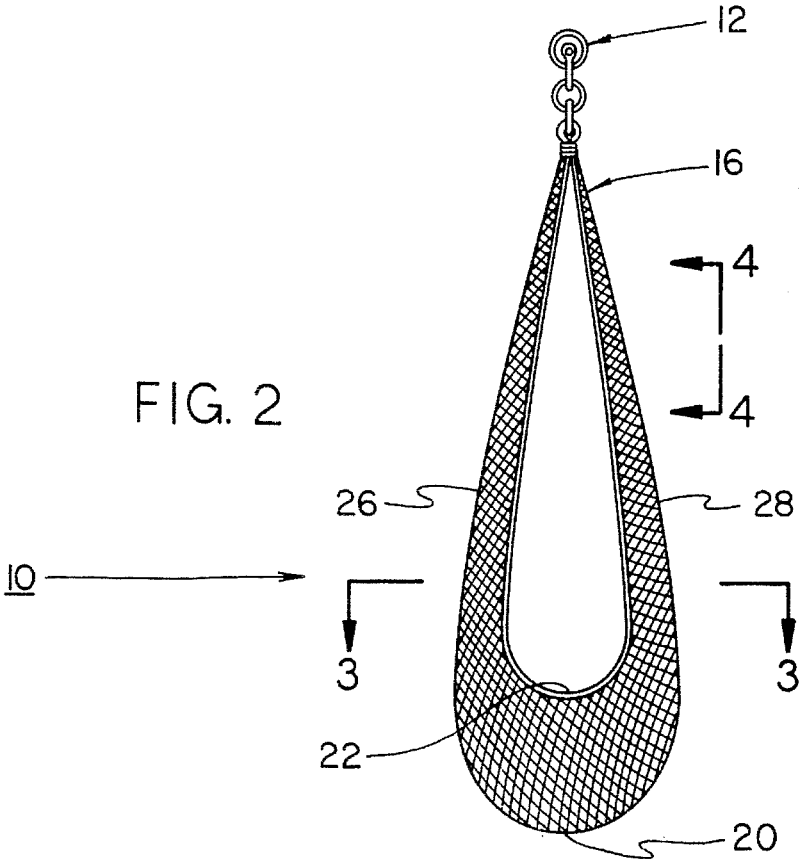
FIG. 2 is a front elevation view thereof.

More specifically, it will be noted that the flexible hat storage device 10 comprises a mounting means 12 for securing to a vertical support surface 14, such as a door or a wall of an associated building. A flexible receiving means 16 is coupled to the mounting means 12 and depends therefrom for receiving and supporting a plurality of hats 18 therewithin, as shown in FIGS. 1 and 2 of the drawings.

Figure 3:
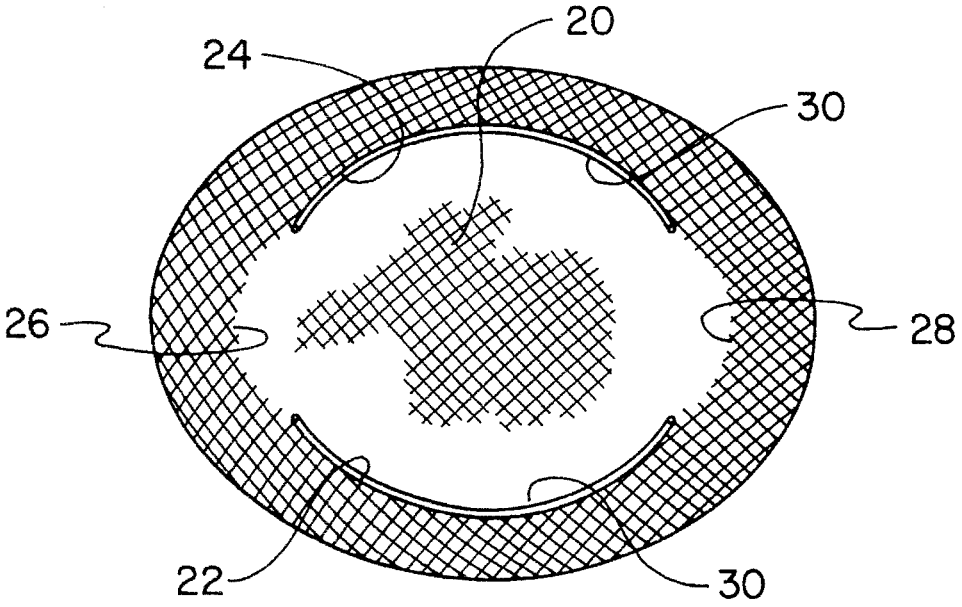
FIG. 3 is a cross-sectional view taken along line 3—3 of FIG. 2.

As best illustrated in FIGS. 1 through 5, it can be shown that the flexible receiving means 16 according to the present invention 10 comprises a substantially hemi-spherical web 20 having a front U-shaped perimeter 22 spaced from a rear U-shaped perimeter 24, as shown in FIG. 3. A first lateral web 26 is coupled to a first side of the hemi-spherical web 20 and extends between the front and rear U-shaped perimeters 22 and 24 thereof. Similarly, a second lateral web 28 is coupled to a second side of the hemi-spherical web 20 and extends between the front and rear U-shaped perimeters 22 and 24 thereof. The lateral webs 26 and 28 extend from the hemi-spherical web 20 and taper towards the mounting means 12 to which they are attached. To this end, the lateral webs 26 and 28 are of a first transverse dimension proximal to the hemi-spherical web 20 and taper to a second transverse dimension proximal to the mounting means 12, wherein the first transverse dimension is substantially greater than the second transverse dimension. Further, it can be shown that the U-shaped perimeters 22 and 24 of the hemi-spherical web 20 continue along the lateral webs 26 and 28.

Figure 4:
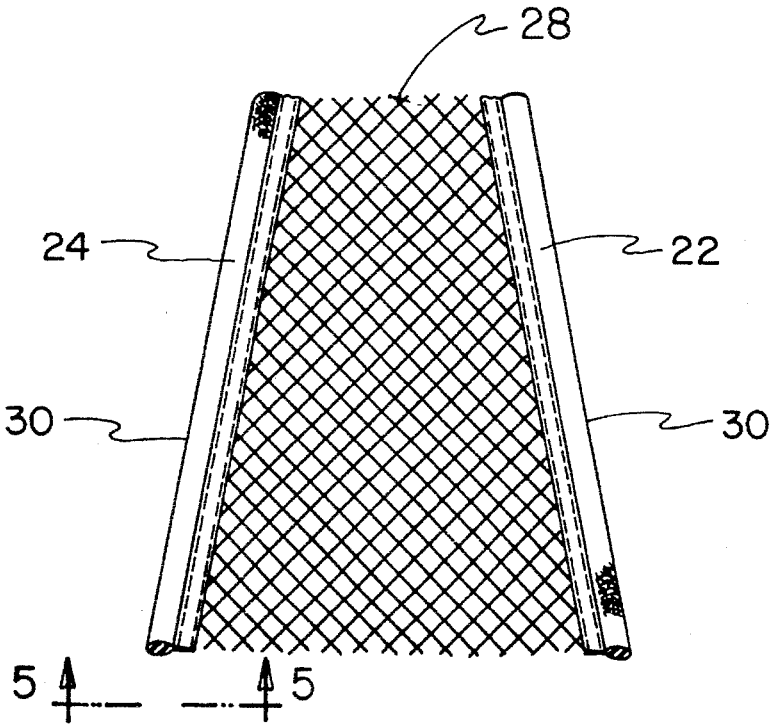
FIG. 4 is an enlarged side elevation view of a portion of the present invention as viewed from line 4—4 of FIG. 2.
Figure 5:
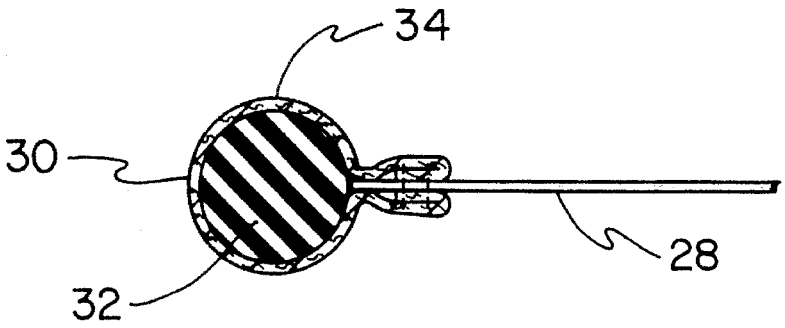
FIG. 5 is an enlarged cross-sectional view as viewed from line 5—5 of FIG. 4.

As shown in FIGS. 3 through 5, the U-shaped perimeters 22 and 24 are provided with an elastic perimeter edge 30 coupled thereto which permits a resilient elongation of the U-shaped perimeters 22 and 24. To this end, and as specifically shown in FIG. 5, an elastic bead 32 is coupled to the associated web, i.e. the second lateral web 28 as shown in FIG. 5, by a fabric envelope 34 extending about the elastic bead and coupled to the associated web by stitching, adhesive, or other fastening means to define the elastic perimeter edge 30. By this structure, hats 18 positioned within the flexible receiving means 16 will be precluded from unintentional or accidental egress therefrom as a result of the contraction of the elastic bead 32.

Figure 6:
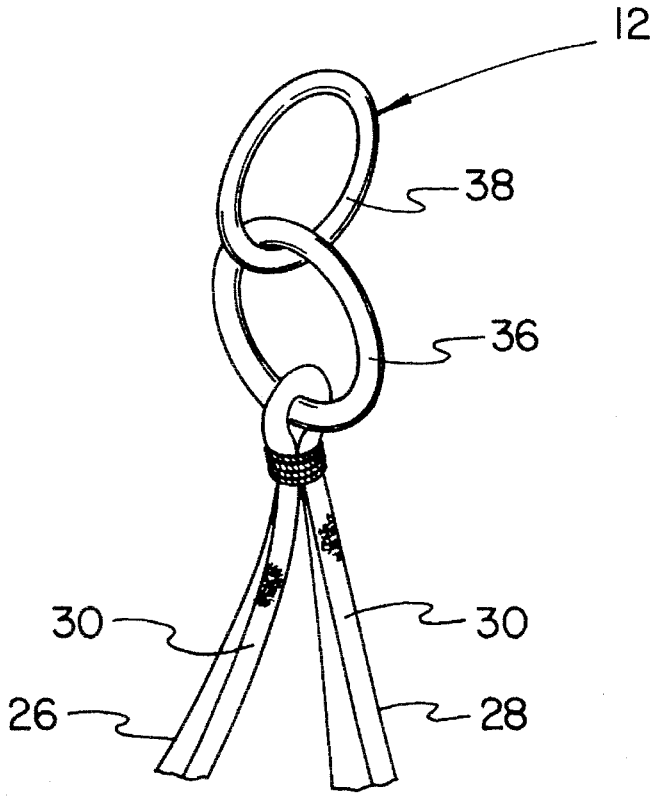
FIG. 6 is an enlarged isometric illustration of a portion of a mounting means of the present invention.
Figure 7:
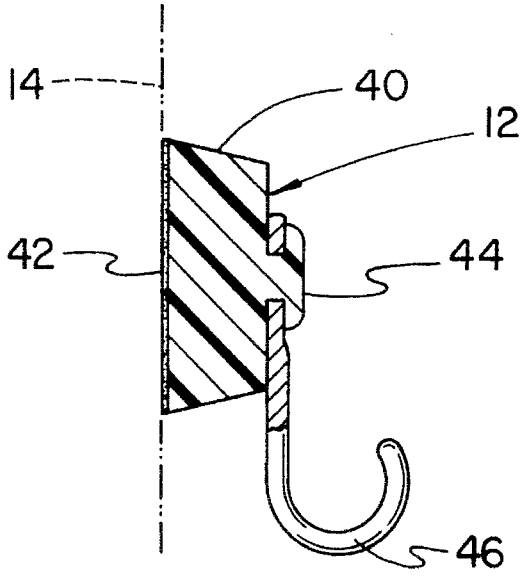
FIG. 7 is a cross-sectional view of a further portion of the mounting means of the present invention.
Figure 8:
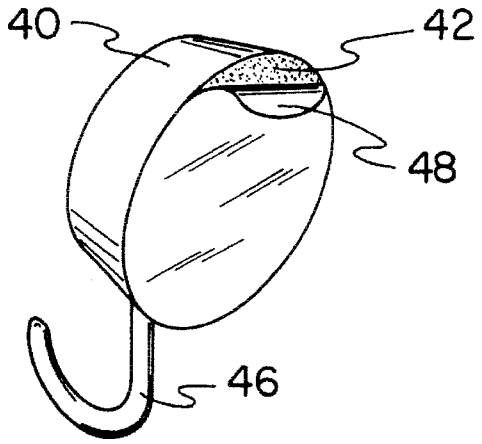
FIG. 8 is an isometric illustration of the further portion of the mounting means.

As shown in FIG. 6, the first lateral web 26 extends into contact with the second lateral web 28 whereat they are coupled together with a first mounting ring 36. A second mounting ring 38 is coupled to the first mounting ring 36, with the mounting rings defining a first portion of the mounting means 12 of the present invention 10. As shown in FIGS. 7 and 8, a second portion of the mounting means 12 comprises a mounting block 40 having an adhesive 42 extending along a planar surface thereof which can be secured to the vertical support surface 14 to couple the mounting means 12 thereto. A mounting projection 44 extends from the mounting block 40 and is directed through a hook 46 so as to rotatably couple the hook relative to the mounting block 40. The hook 46, in turn, is coupled to the mounting ring 38 so as to suspend the flexible receiving means 16 relative to the vertical support surface 14 to which the mounting means 12 is attached. As shown in FIG. 8, the adhesive 42 is preferably covered by a removable backing 48 prior to installation of the device 10, wherein the removable backing 48 can be selectively peeled from the adhesive 42 to expose the same for contact with the vertical support surface 14.

In use, the flexible hat storage device 10 according to the present invention can be easily coupled to a vertical support surface 14 such as a wall or the back side of a door. Hats 18 or the like can be positioned within the flexible receiving means 16 so as to be supported relative to the vertical support surface 14 to which the device 10 is attached.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A flexible hat storage device comprising:

a mounting means for securing to a vertical support surface;

and, a flexible receiving means coupled to the mounting means and depending therefrom for receiving and supporting a plurality of objects therewithin, said flexible receiving means comprising a substantially hemi-spherical web having a front U-shaped perimeter spaced from a rear U-shaped perimeter; a first lateral web coupled to a first side of the hemi-spherical web and extending between the front and rear U-shaped perimeters thereof; and a second lateral web coupled to a second side of the hemi-spherical web and extending between the front and rear U-shaped perimeters thereof, with the lateral webs extending from the hemi-spherical web and towards the mounting means, the lateral webs being attached to the mounting means.

2. The flexible hat storage device of claim 1, wherein the lateral webs are of a first transverse dimension proximal to the hemi-spherical web and taper to a second transverse dimension proximal to the mounting means, wherein the first transverse dimension is substantially greater than the second transverse dimension.

3. The flexible hat storage device of claim 2, wherein the U-shaped perimeters of the hemi-spherical web continue along the lateral webs.

4. The flexible hat storage device of claim 3, wherein the U-shaped perimeters are provided with an elastic perimeter edge coupled thereto which permits a resilient elongation of the U-shaped perimeters, wherein objects positioned within the flexible receiving means will be precluded from unintentional egress therefrom as a result of a contraction of the elastic bead.

5. The flexible hat storage device of claim 4, wherein the elastic perimeter edge comprises an elastic bead coupled to the web; and a fabric envelope extending about the elastic bead and coupled to the web.

6. The flexible hat storage device of claim 5, wherein the first lateral web extends into contact with the second lateral web proximal to the mounting means, and further wherein the mounting means comprises a first mounting ring coupled to the first and second lateral webs; a second mounting ring coupled to the first mounting ring; a mounting block having an adhesive extending along a planar surface thereof; and a mounting projection extending from the mounting block; and a hook rotatably coupled to the mounting projection, the hook being coupled to the second mounting ring.

* * * * *